US005342456A

United States Patent [19]

Dolan

[11] Patent Number: 5,342,456

[45] Date of Patent: Aug. 30, 1994

[54] PROCESS FOR COATING METAL SURFACES TO PROTECT AGAINST CORROSION

[75] Inventor: Shawn E. Dolan, Sterling Heights, Mich.

[73] Assignee: Henkel Corporation, Plymouth Meeting, Pa.

[21] Appl. No.: 47,243

[22] Filed: Apr. 13, 1993

Related U.S. Application Data

[63] Continuation of Ser. No. 752,707, Aug. 30, 1991, abandoned.

[51] Int. Cl.[5] ..... C23C 22/34

[52] U.S. Cl. ..... 148/247; 148/257; 148/255; 148/273; 148/265; 148/268

[58] Field of Search ..... 148/247, 257, 255, 273, 148/265, 268

[56] References Cited

U.S. PATENT DOCUMENTS

| | | | |
|---|---|---|---|
| 3,539,403 | 11/1970 | Ries | 148/6 |
| 4,191,596 | 3/1980 | Dollman et al. | 148/6 |
| 4,496,404 | 1/1985 | King | 146/6 |

FOREIGN PATENT DOCUMENTS

| | | | |
|---|---|---|---|
| 764929 | 4/1954 | Fed. Rep. of Germany . | |
| 1521715 | 2/1970 | Fed. Rep. of Germany . | |
| 2031358 | 12/1971 | Fed. Rep. of Germany . | |
| 3236247 | 4/1984 | Fed. Rep. of Germany | 148/247 |
| 737705 | 2/1983 | United Kingdom | 148/247 |
| 8505131 | 11/1985 | World Int. Prop. O. . | |
| 9207973 | 5/1992 | World Int. Prop. O. . | |

*Primary Examiner*—Sam Silverberg

*Attorney, Agent, or Firm*—Ernest G. Szoke; Wayne C. Jaeschke; Norvell E. Wisdom, Jr.

[57] ABSTRACT

A chromium free conversion coating at least equivalent in corrosion protective quality to conventional chromate conversion coatings can be formed on metals, particularly galvanized steel, by a dry-in-place aqueous acidic liquid comprising:

(A) a component of anions, each of said anions consisting of (i) at least four fluorine atoms and (ii) at least one atom of an element selected from the group consisting of titanium, zirconium, hafnium, silicon, and boron and, optionally, (iii) one or more oxygen atoms;

(B) a component of cations of elements selected from the group consisting of cobalt, magnesium, manganese, zinc, nickel, tin, zirconium, iron, aluminum and copper; the ratio of the total number of cations of this component to the total number of anions of component (A) being at least 2:5; and (C) sufficient free acid to give the composition, after dilution with from 1 to 19 times its own weight of water, a pH in the range from 0.5 to 5.0; and, optionally, (D) a composition that will form an organic resinous film upon drying in place.

10 Claims, No Drawings

PROCESS FOR COATING METAL SURFACES TO PROTECT AGAINST CORROSION

CROSS REFERENCE TO RELATED APPLICATION

This application is a continuation of application Ser. No. 752,707 filed Aug. 30, 1991, now abandoned.

BACKGROUND OF THE INVENTION

1. Field of the Invention

This invention relates to processes of treating metal surfaces with aqueous acidic compositions for forming conversion coatings by drying in place. The invention is particularly suited to treating iron and steel, galvanized iron and steel, zinc and those of its alloys that contain at least 50 atomic percent zinc, and aluminum and its alloys that contain at least 50 atomic percent aluminum.

2. Statement of Related Art

A very wide variety of materials have been taught in the prior art for the general purposes of the present invention, but most of them contain hexavalent chromium which is environmentally undesirable. The specific items of related art believed by the applicant to be most nearly related to the present invention are noted below.

U.S. Pat. No. 4,921,552 of May 1, 1990 to Sander et al. teaches treating aluminum with a composition comprising fluozirconic acid, hydrofluoric acid, and a water soluble polymer.

Published European Patent Application 0 273 698 (published Jul. 6, 1988) teaches aqueous acidic treating solutions comprising trivalent metal compounds, silica, and preferably also nickel and/or fluoride ions. The counter anions for the trivalent metal cations used may be silicofluoride.

South African Patent 85/3265 granted Dec. 24, 1985 teaches treating metal surfaces, including galvanized iron and steel, with an acidic aqueous composition comprising a fluoride containing compound selected from hydrofluoric acid and fluoboric, fluosilicic, fluotitanic, and fluozirconic acids and their salts; one or more salts of a metal such as cobalt, nickel, copper, iron, manganese, strontium, and zinc; and, optionally, a sequestrant and/or a polymer of acrylic acid, methacrylic acid, or esters thereof. Metal surfaces are treated with this composition, then rinsed with water, and preferably are then rinsed with a solution containing chromic acid.

U.S. Pat. No. 4,339,310 of Jul. 13, 1982 to Oda et al. teaches an aqueous chromium free composition comprising a soluble compound of titanium or zirconium which may be fluotitanate or fluozirconate, a pyrazole compound, a myoinositol phosphate ester or a salt thereof, and a silicon compound which may be "silicon hydrofluoride" or "ammonium silicafluoride" as a useful surface treatment for tin cans.

U.S. Pat. 4,273,592 of Jun. 16, 1981 to Kelly teaches an acidic aqueous composition comprising a zirconium or hafnium compound which may be the fluozirconate or fluohafnate, a fluoride compound which may also be the noted complex fluoride compounds, and a polyhydroxy compound having no more than about seven carbon atoms. The composition is substantially free from hexavalent chromium and elements such as boron, manganese, iron, cobalt, nickel, molybdenum, and tungsten and also substantially free from ferricyanide and ferrocyanide.

U.S. Pat. No. 4,148,670 of Apr. 10, 1979 to Kelly teaches treating aluminum with an aqueous composition comprising a zirconium or titanium compound which may be the fluozirconate or fluotitanate, a fluoride compound which may also be the noted complex fluoride compounds, and phosphate ions.

U.S. Pat. No. 3,593,403 of Nov. 10, 1970 to Ries teaches treating galvanized and other zinciferous metal surfaces with aqueous acidic compositions comprising complex fluorides of iron, titanium, zirconium, and/or silicon and at least one oxidizer.

U.S. Pat. No. 3,506,499 of Apr. 14, 1970 to Okada et al. teaches treating aluminum and zinc surfaces with an aqueous solution of chromic acid and colloidal silica.

U.S. Pat. No. 3,160,506 of Dec. 8, 1964 to O'Connor et al. teaches preparing a metal substrate for application of a photographic emulsion by contacting the metal substrate with an aqueous solution containing an acid, alkali metal, or alkaline earth metal salt of a transition metal fluoride and sealing the layer formed thereby by subsequent treatment with chromic acid.

U.S. Pat. No. 3,066,055 of Nov. 27, 1962 to Pimbley teaches treating aluminum surfaces with a composition comprising transition metal cations having atomic numbers from 23–29 inclusive and preferably also comprising hexavalent chromium, molybdate, or tungstate anions and halogen anions, which may be complex fluorides.

U.S. Pat. No. 2,825,697 of Mar. 4, 1958 to Carroll et al. teaches treating aluminum and its alloys with an aqueous composition comprising a fluorine bearing compound which may be fluozirconic, fluosilicic, fluoboric, fluotitanic, or fluostannic acids or their salts together with at least 0.4 grams per liter (hereinafter "g/L") of $CrO_3$ (or its stoichiometric equivalent of other types of hexavalent chromium).

U.S. Pat. No. 2,276,353 of Mar. 17, 1942 to Thompson teaches treating metals with a combination of fluosilicic acid or its salts and an oxidizing agent.

U.S. Pat. No. 1,710,743 of Apr. 30, 1929 to Pacz teaches treating aluminum with aqueous solutions containing complex fluoride ions and optionally also including cations of silver, nickel, cobalt, zinc, cadmium, antimony, tin, lead, iron, and manganese. The amount of the compounds present containing these heavy metal cations must be substantially less than that of the complex fluoride salts present, with amounts of about one-tenth that of the complex fluoride being noted as excellent.

U.S. Pat. No. 1,638,273 of Aug. 9, 1927 to Pacz teaches treating aluminum surfaces with an aqueous composition comprising a combination of a nickel or cobalt salt, a soluble fluosilicate salt, and an alkali nitrate, phosphate, or sulfate.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the exact numerical limits stated is generally preferred.

SUMMARY OF THE INVENTION

It has been found that excellent resistance to corrosion, particularly after subsequent conventional coating with an organic binder containing protective coating, can be imparted to active metal surfaces, particularly to iron and steel, aluminum and its alloys that contain at least 50 atomic percent aluminum, zinc and those of its alloys that contain at least 50 atomic percent zinc, and, most preferably, galvanized iron and steel, by drying in place on the surface of the metal a layer of a liquid composition comprising, or preferably consisting essentially of, water and:

(A) a component of anions, each of said anions consisting of (i) at least four fluorine atoms and (ii) at least one atom of an element selected from the group consisting of titanium, zirconium, hafnium, silicon, and boron and, optionally, (iii) one or more oxygen atoms; preferably the anions are fluotitanate (i.e., $TiF_6^{-2}$) or fluozirconate (i.e., $ZrF_6^{-2}$);

(B) a component of cations of elements selected from the group consisting of cobalt, magnesium, manganese, zinc, nickel, tin, zirconium, iron, aluminum and copper, preferably cobalt, nickel or magnesium, most preferably cobalt; preferably, with increasing preference in the order given, the ratio of the total number of cations of this component to the total number of anions of component (A) is at least 1:3, 2:5, 3:5, 7:10, or 4:5; and (C) sufficient free acid to give the composition a pH in the range from 0.5 to 5.0, preferably from 1.7 to 4.0, more preferably in the range from 2.0 to 4.0, or still more preferably in the range from 2.5 to 3.5; and, optionally, (D) a composition that will form an organic film upon drying in place.

The composition that will form an organic film upon drying in place may be (i) a solution of a water soluble polymer and/or dispersion of a water insoluble polymer that has a sufficiently high molecular weight and sufficiently low glass transition temperature to form a continuous film spontaneously upon drying, (ii) monomers and/or oligomers of addition polymerizable compounds that will polymerize under the conditions of drying, but will not polymerize to any substantial degree under the conditions of storage in solution, and/or (iii) combinations of two or more types of molecules that will form elimination polymers under the conditions of drying, but will not polymerize to any substantial degree under the conditions of storage in solution. Aminoplast resins are a preferred example of the latter type of film forming composition.

It should be understood that this description does not preclude chemical interactions among the components listed, but instead describes the components of a composition according to the invention in the form in which they are generally used as ingredients to prepare such a composition.

DESCRIPTION OF PREFERRED EMBODIMENTS

It is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, or 0.001 percent by weight (hereinafter "w/o") of each of the following constituents: hexavalent chromium; silica; silicates that do not contain at least four atoms of fluorine per atom of silicon; ferricyanide; ferrocyanide; anions containing molybdenum or tungsten; nitrates and other oxidizing agents (the others being measured as their oxidizing stoichiometric equivalent as nitrate); phosphorous and sulfur containing anions that are not oxidizing agents; alkali metal and ammonium cations; pyrazole compounds; sugars; gluconic acid and its salts; glycerine; α-glucoheptanoic acid and its salts; and myo-inositol phosphate esters and salts thereof.

Furthermore, in a process according to the invention that includes other steps than the drying into place on the surface of the metal of a layer of a composition as described above, it is preferred that none of these other steps include contacting the surfaces with any composition that contains more than, with increasing preference in the order given, 1.0, 0.35, 0.10, 0.08, 0.04, 0.02, 0.01, 0,003, 0,001, or 0.0002 w/o of hexavalent chromium.

In one embodiment of the invention, it is preferred that the acidic aqueous composition as noted above be applied to the metal surface and dried thereon within a short time interval. With increasing preference in the order given, the time interval during which the liquid coating is applied to the metal being treated and dried in place thereon, when heat is used to accelerate the process, is not more than 25, 15, 9, 7, 4, 3, 1.8, 1.0, or 0.7 second (hereinafter "sec"). In order to facilitate this rapid completion of the two basic steps of a process according to this invention, it is often preferred to apply the acid aqueous composition used in the invention to a warm metal surface, such as one rinsed with hot water after initial cleaning and very shortly before applying the aqueous composition according to this invention, and/or to use infrared or microwave radiant heating in order to effect very fast drying of the applied coating. In such an operation, a peak metal temperature in the range from 30°-200° C., or more preferably from 40°-90° C., would normally be used.

In an alternative embodiment, which is equally effective technically and is satisfactory when ample time is available at acceptable economic cost, the liquid coating may be applied to the metal substrate and allowed to dry at a temperature not exceeding 40° C. In such a case, there is no particular advantage to fast drying.

The effectiveness of a treatment according to the invention appears to depend predominantly on the total amounts of the active ingredients that are dried in place on each unit area of the treated surface, and on the nature and ratios of the active ingredients to one another, rather than on the concentration of the acidic aqueous composition used. Thus, if the surface to be coated is a continuous flat sheet or coil and precisely controllable coating techniques such as roll coaters are used, a relatively small volume per unit area of a concentrated composition as described below may effectively be used for direct application. On the other hand, for some coating equipment, it is equally effective to use a more dilute acidic aqueous composition to apply a heavier liquid coating that contains about the same amount of active ingredients.

Preferably the amount of composition applied in a process according to this invention is chosen so as to result in an add-on mass of the metal in the complex fluoride anions described in part (A) of the composition above in the range from 5 to 500 milligrams per square meter (hereinafter "$mg/m^2$") of surface treated. If the metal in the complex fluoride anions is titanium, the addon mass is more preferably 10 to 270 $mg/m^2$, or still more preferably 18-125 $mg/m^2$. If the metal in the complex fluoride anions is zirconium, the add-on mass is more preferably 10–220 mg/m$^2$, or still more preferably 17–120 mg/m$^2$.

In a concentrated acidic aqueous composition to be used according to the invention, either directly as a working composition or as a source of active ingredients for making up a more dilute working composition, the concentration of component (A) as described above is preferably from 0.15 to 1.0 gram moles per kilogram of total composition (hereinafter "M/kg"), or more preferably from 0.30 to 0.75 M/kg. If component (D) is present, its concentration in a concentrated composition is preferably from 0.5 to 5 w/o, or more preferably from 1.2–2.4 w/o. Working compositions, i.e., those suitable for direct application to metal in a process according to this invention, preferably contain at least 5 w/o, or more preferably at least 10 w/o, of the concentrations of active ingredients as described above for a concentrated composition.

A working composition according to the invention may be applied to a metal workpiece and dried thereon by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed before drying by any convenient method, such as drainage under the influence of gravity, squeegees, passing between rolls, and the like. Drying also may be accomplished by any convenient method, such as a hot air oven, exposure to infra-red radiation, microwave heating, and the like.

For flat and particularly continuous flat workpieces such as sheet and coil stock, application by a roller set in any of several conventional arrangements, followed by drying in a separate stage, is generally preferred. The temperature during application of the liquid composition may be any temperature within the liquid range of the composition, although for convenience and economy in application by roller coating, normal room temperature, i.e., from 20°–30° C., is usually preferred. In most cases for continuous processing of coils, rapid operation is favored, and in such cases drying by infrared radiative heating, to produce a peak metal temperature in the range already given above, is generally preferred.

Alternatively, particularly if the shape of the substrate is not suitable for roll coating, a composition may be sprayed onto the surface of the substrate and allowed to dry in place; such cycles can be repeated as often as needed until the desired thickness of coating, generally measured in grams of add-on mass per square meter (hereinafter "g/m$^2$"), is achieved. For this type of operation, it is preferred that the temperature of the metal substrate surface during application of the working composition be in the range from 20 to 300, more preferably from 30 to 100, or still more preferably from 30° to 90 ° C.

The amount of protective film formed by a process according to the invention may be conveniently monitored and controlled by measuring the add-on weight or mass of the metal atoms in the anions of component (A) as defined above. The amount of these metal atoms may be measured by any of several conventional analytical techniques known to those skilled in the art. The most reliable measurements generally involve dissolving the coating from a known area of coated substrate and determining the content of the metal of interest in the resulting solution.

Preferably, the metal surface to be treated according to the invention is first cleaned of any contaminants, particularly organic contaminants and foreign metal fines and/ or inclusions. Such cleaning may be accomplished by methods known to those skilled in the art and adapted to the particular type of metal substrate to be treated. For example, for galvanized steel surfaces, the substrate is most preferably cleaned with a conventional hot alkaline cleaner, then rinsed with hot water, squeegeed, and dried. For aluminum, the surface to be treated most preferably is first contacted with a conventional hot alkaline cleaner, then rinsed in hot water, then, optionally, contacted with a neutralizing acid rinse, before being contacted with an acid aqueous composition as described above.

The invention is particularly well adapted to treating surfaces that are to be subsequently further protected by applying conventional organic protective coatings over the surface produced by treatment according to the invention.

The practice of this invention may be further appreciated by consideration of the following, non-limiting, working examples, and the benefits of the invention may be further appreciated by reference to the comparison examples.

EXAMPLES

Test Methods and Other General Conditions

Test pieces of hot dipped galvanized steel were spray cleaned for 10 seconds at 54° C. with an aqueous cleaner containing 7 g/L of PARCO TM CLEANER 338 (commercially available from the Parker+Amchem Division of Henkel Corp., Madison Heights, Mich., USA). After cleaning, the panels were rinsed with hot water, squeegeed, and dried before roll coating with an acidic aqueous composition as described for the individual examples and comparison examples below. This applied liquid was flash dried in an infrared oven that produces approximately 49° C. peak metal temperature.

The mass per unit area of the coating was determined on samples at this point in the process by dissolving the coating in aqueous hydrochloric acid and determining the zirconium or titanium content in the resulting solution by inductively coupled plasma spectroscopy, which measures the quantity of a specified element.

T-Bend tests were according to American Society for Testing Materials (hereinafter "ASTM") Method D4145-83; Impact tests were according to ASTM Method D2794-84E1; Salt Spray tests were according to ASTM Method B-117-90 Standard; and Humidity tests were according to ASTM D2247-8 Standard.

EXAMPLE 1

The acidic aqueous composition used for this example contained the following ingredients:

82.5 parts by weight of $CoCO_3$;

550.5 parts by weight of 20 w/o aqueous $H_2ZrF_6$ also containing 2.1 w/o HF; and 367.0 parts by weight of deionized water.

All ingredients were combined with stirring and $CO_2$ gas is evolved.

EXAMPLE 2

The acidic aqueous composition used for this example contained the following ingredients:

45.2 parts by weight of $MgCO_3$;
132.6 parts by weight of aqueous 60 w/o $H_2TiF_6$;
751.5 parts by weight of deionized water; and
70.7 parts by weight of an aqueous solution containing adduct of poly{4-vinylphenol} with N-methylethanolamine and formaldehyde) made according to the directions of Example 1 of U.S. Pat. No. 4,517,028, except that PROPASOL TM P (a propoxylated propane solvent commercially available from Union Carbide Corporation) was used as the solvent instead of ethanol and no nitric acid was added.

The first three ingredients were mixed as in Example 1, and after the reaction ceased, the last ingredient was added with stirring.

EXAMPLE 3

The acidic aqueous composition used for this example contained the following ingredients:

56.0 parts by weight of $CoCO_3$;
149.9 parts by weight of aqueous 60 w/o $H_2TiF_6$;
719.1 parts by weight of deionized water; and
75.0 parts by weight of an aqueous solution containing 28.4 w/o solids of the same water soluble polymer as in Example 2.

The first three ingredients were mixed as in Example 1, and after the reaction ceased, the last ingredient was added with stirring.

EXAMPLE 4

The acidic aqueous composition used for this example contained the following ingredients:

56.0 parts by weight of $CoCO_3$;
149.9 parts by weight of aqueous 60 w/o $H_2TiF_6$;
734.6 parts by weight of deionized water; and
59.5 parts by weight of AEROTEX TM 900 Reactant (ethylene modified urea resin, commercially available from American Cyanamid Co.)

The first three ingredients were mixed as in Example 1, and after the reaction ceased, the last ingredient was added with stirring.

COMPARATIVE EXAMPLE 1

The acidic aqueous composition used for this example contained the following ingredients:

38.6 parts by weight of aqueous 60 w/o $H_2TiF_6$;
941.6 parts by weight of deionized water; and
19.8 parts by weight of the same water soluble polymer solution as in Examples 2 and 3.

All ingredients were combined with stirring.

COMPARATIVE EXAMPLE 2

The acidic aqueous composition used for this example contained the following ingredients:

207.1 parts by weight of aqueous 45 w/o $H_2ZrF_6$;
651.8 parts by weight of deionized water; and
141.1 parts by weight of the same water soluble polymer solution as in Examples 2 and 3.

All ingredients were combined with stirring.

COMPARATIVE EXAMPLE 3

The acidic aqueous composition used for this example contained the following ingredients:

207.2 parts by weight of aqueous 45 w/o $H_2ZrF_6$;
770.8 parts by weight of deionized water; and
22.0 parts by weight of the same water soluble polymer solution as in Examples 2 and 3.

All ingredients were combined with stirring.

COMPARATIVE EXAMPLE 4

The acidic aqueous composition used for this example contained the following ingredients:

207.2 parts by weight of aqueous 45 w/o $H_2ZrF_6$;
324.8 parts by weight of deionized water; and
468.0 parts by weight of an aqueous solution containing w/o solids of a water soluble polymer made according to the directions of Example 1 of U.S. Pat. No. 4,963,596.

All ingredients were combined with stirring.

COMPARATIVE EXAMPLE 5

The acidic aqueous composition used for this example contained the following ingredients:

201.0 parts by weight of aqueous 60 w/o $H_2TiF_6$;
620.1 parts by weight of deionized water;
73.7 parts by weight of aqueous 28 w/o ammonia; and
105.2 parts by weight of the same water soluble polymer solution as in Examples 2 and 3.

The first three ingredients listed were mixed with stirring, then the last ingredient was added with stirring.

CONTROL (A TYPE OF COMPARATIVE EXAMPLE)

The composition used here was made from BONDERITE TM 1415A, a chromium containing dry-in-place treatment that is commercially available from Parker+Amchem Div. of Henkel Corp., Madison Heights, Mich., USA. The material was prepared and used as directed by the manufacturer, under the same conditions as those of the other comparative examples.

The coating amounts obtained in these examples and comparison examples are shown in Table 1.

TABLE 1

COATING WEIGHTS (MASSES) IN EXAMPLES 1–4 AND COMPARATIVE EXAMPLES 1–5

| | Milligrams/Square Meter of: | |
|---|---|---|
| | Zr | Ti |
| Example 1 | 26 | |
| Example 2 | | 21 |
| Example 3 | | 21 |
| Example 4 | | 110 |
| Comparative Example 1 | | 21 |
| Comparative Example 2 | 26 | |
| Comparative Example 3 | 34 | |
| Comparative Example 4 | 22 | |
| Comparative Example 5 | | 30 |

The test sheets prepared as described above were then coated according to the supplier's directions with one or more conventional primer and topcoat protective coating compositions as identified in the Tables below, then subjected to conventional tests as identified above to determine the protective value of the coatings. Results are shown in Tables 2–4 below.

TABLE 2

TEST RESULTS WITH GREY CERAM-A-SIL TM PAINT[1]

| Treatment | T-bends 3T | Reverse Impact Room Temp 80 in.lbs. | Salt Spray 1008 hours | Humidity 1008 hrs |
|---|---|---|---|---|
| B-1415A Control | = | = | = | = |

TABLE 2-continued

TEST RESULTS WITH GREY CERAM-A-SIL ™ PAINT[1]

| Treatment | T-bends 3T | Reverse Impact Room Temp 80 in.lbs. | Salt Spray 1008 hours | Humidity 1008 hrs |
|---|---|---|---|---|
| Example 1 | = | = | + | = |

Notes for Table 2
[1]Akzo Coatings SA3Z 15025 topcoat over Akzo Coatings HYDRASEA ™ WY9R 13063 primer
+ Indicates performance better than the control
= indicates performance equal to the control

TABLE 3

TEST RESULTS WITH BROWN FLUOROPOLYMER[1]

| Treatment | T-Bend 1T | Impacts R.T.[2] 80in.lb | cold[3] 80in.lb | Salt Spray 1008 hours | Humidity 1008 hours |
|---|---|---|---|---|---|
| B-1415A Control | = | = | = | = | = |
| Example 1 | = | = | = | = | = |
| Example 2 | = | = | = | = | = |
| Example 3 | = | = | = | = | = |
| Example 4 | = | = | = | = | = |

Notes for Table 3
[1]Valspar FLUROPON ™ Topcoat 454K309 over Valspar KOROLITH ™ 803X403 Primer
[2]Room temperature
[3]cold = −23° Centigrade.
= indicates equal performance to control.
− indicates poor performance as compared to control.
-- indicates very poor performance as compared to control

TABLE 4

TEST RESULTS WITH BLUE VINYL PLASTISOL[1]

| Treatment | T-Bend 1T | Impacts R.T.[2] 80in.lb | cold[3] 80in.lb | Salt Spray 1008 hours | Humidity 1008 hours |
|---|---|---|---|---|---|
| Control | = | = | = | = | = |
| Example 1 | = | = | = | = | = |
| Example 2 | = | = | = | = | = |
| Example 3 | = | = | = | = | = |
| Example 4 | = | = | = | = | = |
| Comparative Example 1 | = | = | − | -- | = |
| Comparative Example 2 | = | = | − | -- | = |
| Comparative Example 3 | = | = | -- | -- | = |
| Comparative Example 4 | = | = | − | -- | = |
| Comparative Example 5 | = | = | -- | -- | = |

Notes for Table 4
[1]Sherwin Williams G77 L C78 SUPER CLAD ™ 1130 Topcoat over Sherwin Williams SUPER CLAD ™ P66 Y C1 Primer
[2]Room temperature
[3]cold = −23° Centigrade.
= indicates equal performance to control.
− indicates poor performance as compared to control.
-- indicates very poor performance as compared to control

What is claimed is:

1. A process for forming a protective coating on the surface of a metal substrate selected from the group consisting of iron, steel, galvanized iron and steel, aluminum and its alloys that contain at least 50 atomic percent aluminum, and zinc and those of its alloys that contain at least 50 atomic percent zinc, said process comprising steps of:

(I) covering said surface with a layer of an aqueous acidic liquid composition consisting essentially of water and:

(A) from 0.015 to 0.75 M/kg of a component of actions, each of said anions consisting of (i) at least four fluorine atoms and (ii) at least one atom of an element selected from the group consisting of titanium, zirconium, hafnium, silicon, and boron and, optionally, (iii) one or more oxygen atoms;

(B) a component of cations of cations of elements selected from the group consisting of cobalt, magnesium, manganese, zinc, nickel, tin, zirconium, iron, aluminum and copper; the ratio of the total number of cations of this component to the total number of anions of component (A) being at least about 3:5; and (C) sufficient free acid to give the composition a pH in the range from about 0.5 to about 5.0; and, optionally, (D) a composition that will form an organic film upon drying in place, said aqueous acidic liquid composition containing no more than about 0.001 w/o of hexavalent chromium, no more than about 0.10 w/o of phosphate anions, no more than about 0.10 w/o of nitrates and other oxidizing agents (the others being measured as their oxidizing stoichiometric equivalent as nitrate), and no more than about 0.35 w/o of each of silica; silicates that do not contain at least four atoms of fluorine per atom of silicon; ferricyanide; ferrocyanide; anions containing molybdenum or tungsten; sulfur containing anions that are not oxidizing agents; alkali metal and ammonium cations; pyrazole compounds; sugars; gluconic acid and its salts; glycerine; c-glucoheptanoic acid and its salts; and myoinositol phosphate esters and salts thereof; and (II) drying in place, without intermediate rinsing, said layer of an aqueous acidic liquid composition, to form a conversion coating on the substrate; and (III) without any intermediate contact of said conversion coating with any rinse liquid containing more than 0.01 w/o of hexavalent chromium, applying a protective coating including an organic binder over the dried conversion coating formed in step (II).

2. A process according to claim 1, wherein said aqueous acidic liquid composition contains a number of cations of component (B) that is at least about 60 % of the number of anions of component (A) present in the composition.

3. A process according to claim 2, wherein the pH of said aqueous acidic liquid composition is in the range from about 1.7 to about 4.0.

4. A process according to claim 3, wherein step (II) is accomplished by heating the metal substrate to a peak temperature in the range from 40°-90° C. by infrared radiative heating.

5. A process according to claim 4, wherein either (a) the ions of component (A) are fluozirconate ions and the add-on mass of zirconium is in the range from about 10 to about 220 milligrams per square meter of surface coated or (b) the ions of component (A) are fluotitanate ions and the add-on mass of titanium is in the range from about 10 to about 270 milligrams per square meter of surface coated.

6. A process according to claim 3, wherein either (a) the ions of component (A) are fluozirconate ions and the add-on mass of zirconium is in the range from about 10 to about 220 milligrams per square meter of surface coated or (b) the ions of component (A) are fluotitanate ions and the add-on mass of titanium is in the range from about 10 to about 270 milligrams per square meter of surface coated.

7. A process according to claim 6, wherein said aqueous acidic liquid composition contains not more than about 1.0 M/kg of component (A) and not more than 5 w/o of component (D).

8. A process according to claim 7, wherein the pH of said aqueous acidic liquid composition is in the range from about 2.0 to about 3.8.

9. A process according to claim 6, wherein the pH of said aqueous acidic liquid composition is in the range from about 2.0 to about 3.8.

10. A process according to claim 1, wherein the pH of said aqueous acidic liquid composition is in the range from about 2.0 to about 3.8.

* * * * *

UNITED STATES PATENT AND TRADEMARK OFFICE

CERTIFICATE OF CORRECTION

PATENT NO. : 5,342,456

DATED : August 30, 1994

INVENTOR(S) : Shawn E. Dolan

It is certified that error appears in the above-indentified patent and that said Letters Patent is hereby corrected as shown below:

In claim 1, column 9, line 68, "actions", should read: -- anions --.

In claim 1, column 19, line 6, "of cations, of cations", should read: -- of cations --.

In claim 1, column 10, line 31, "c-glucoheptanoic", should read:
-- α-glucoheptanoic --.

Signed and Sealed this

Sixteenth Day of May, 1995

*Attest:*

Bruce Lehman

BRUCE LEHMAN

*Attesting Officer*

*Commissioner of Patents and Trademarks*